US007350865B2

(12) United States Patent
Pearse

(10) Patent No.: US 7,350,865 B2
(45) Date of Patent: Apr. 1, 2008

(54) CHAIR HAVING MOVABLE THIGH LEVERS

(76) Inventor: Steven Pearse, 1814 Penhurst Road, Victoria, British Columbia (CA) V8N 2N7

( * ) Notice: Subject to any disclaimer, the term of this patent is extended or adjusted under 35 U.S.C. 154(b) by 0 days.

(21) Appl. No.: 11/593,142

(22) Filed: Nov. 3, 2006

(65) Prior Publication Data

US 2007/0102968 A1 May 10, 2007

(30) Foreign Application Priority Data

Nov. 4, 2005 (CA) ..... 2,526,108

(51) Int. Cl.
*A47C 1/022* (2006.01)

(52) U.S. Cl. ..... 297/312

(58) Field of Classification Search ..... 297/258.1, 297/201, 312; 482/57
See application file for complete search history.

(56) References Cited

U.S. PATENT DOCUMENTS

| | | | | |
|---|---|---|---|---|
| 2,707,465 | A | | 5/1955 | Nemeth |
| 4,541,668 | A | | 9/1985 | Rouw |
| 4,541,669 | A | | 9/1985 | Goldner |
| 4,834,072 | A | | 5/1989 | Goodman |
| 4,966,413 | A | | 10/1990 | Palarski |
| 5,113,851 | A | | 5/1992 | Gamba |
| 5,258,019 | A | | 11/1993 | Riddle et al. |
| 5,288,127 | A | * | 2/1994 | Berg et al. ..... 297/312 |
| 5,597,203 | A | | 1/1997 | Hubbard |
| 6,340,207 | B1 | | 1/2002 | Brightbill et al. |
| 6,357,827 | B1 | | 3/2002 | Brightbill et al. |
| 2004/0015108 | A1 | | 1/2004 | McNally et al. |

FOREIGN PATENT DOCUMENTS

| | | | |
|---|---|---|---|
| CA | 2 429 829 | | 11/2004 |
| EP | 1616504 | A2 * | 1/2006 |

* cited by examiner

*Primary Examiner*—Milton Nelson, Jr.
(74) *Attorney, Agent, or Firm*—Davis Bujold & Daniels, P.L.L.C.

(57) ABSTRACT

A chair that has movable thigh levers to permit a shifting of body weight when seated and thereby relieve spinal discomfort and pressure points experienced when seated for long periods. A lever support rocker is provided to coordinate movement of the thigh levers. Downward pressure exerted by a user's thigh to lower a first thigh activated lever causes a rocking movement of the lever support rocker which results in an upwardly movement of a second thigh activated lever.

14 Claims, 6 Drawing Sheets

CHAIR HAVING MOVABLE THIGH LEVERS

This application claims priority from Canadian Application Serial No. 2,526,108 filed Nov. 4, 2005.

FIELD OF THE INVENTION

The present invention relates to a chair that has movable thigh levers to relieve spinal discomfort and pressure points experienced when seated for long periods.

BACKGROUND OF THE INVENTION

Office workers spend hours seated in their chairs. It has long been recognized that this is not healthy due to the stress placed upon the spine and pressure points exerted upon the buttocks. U.S. Pat. No. 5,113,851 (Gamba 1992) entitled "Chair with a swinging seat" is an example of an attempt to address this problem.

There are apparatus that have been developed that have movable thigh levers. Canadian Patent 2,429,829 (Cholet 2004) entitled "Glutemax cardio exercise apparatus", is an example of a modified form of exercise bicycle that has movable thigh levers. This exercise apparatus is for cardio workouts and is not suitable for office use.

SUMMARY OF THE INVENTION

According to the present invention there is provided a chair that has movable thigh levers to permit a shifting of body weight when seated and thereby relieve spinal discomfort and pressure points experienced when seated for long periods.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
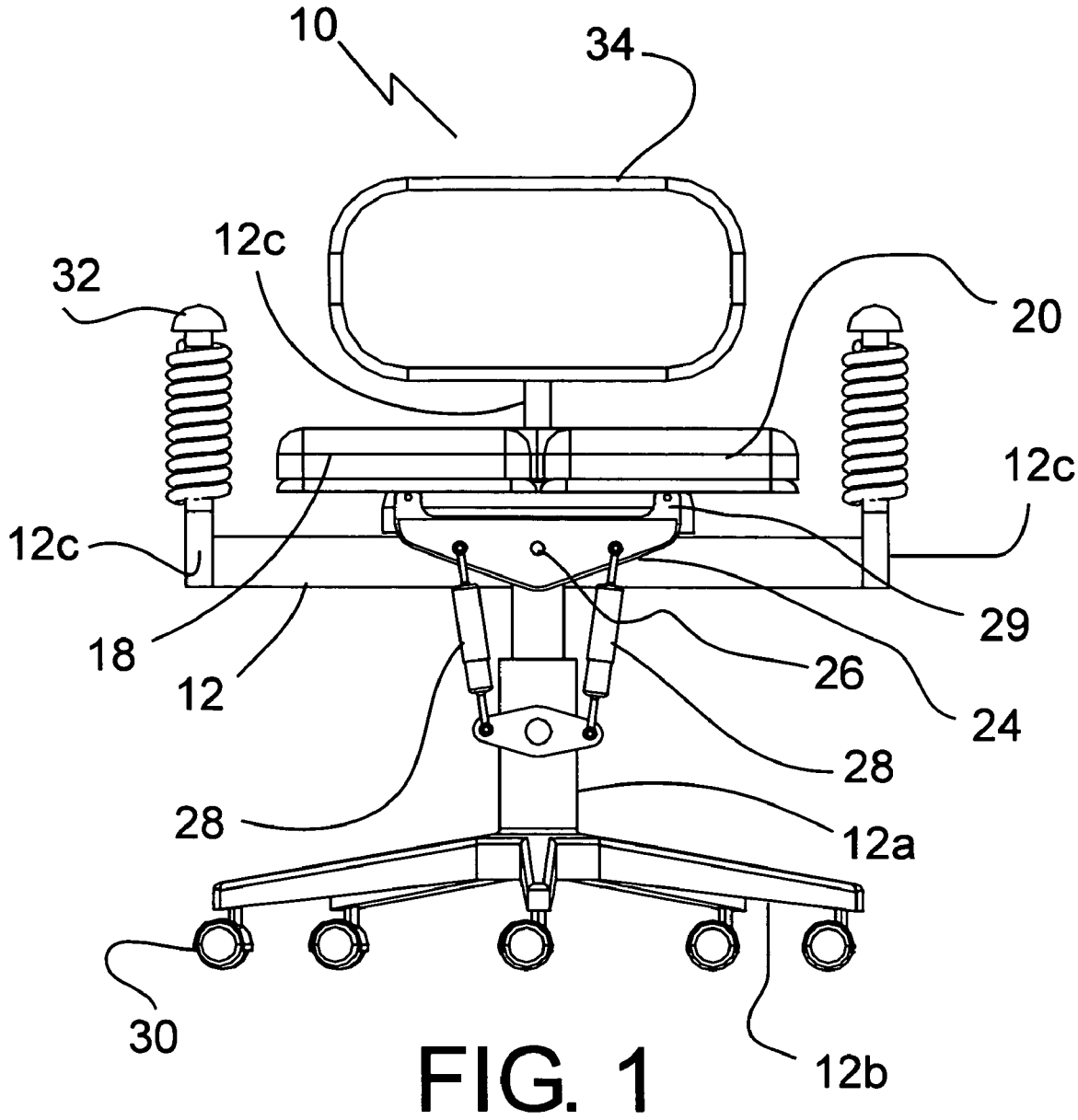
FIG. 1 is a front elevation view of the chair constructed in accordance with the present invention.

The preferred embodiment, a chair generally identified by reference numeral 10, will now be described with reference to FIG. 1 through FIG. 4.

Figure 2:
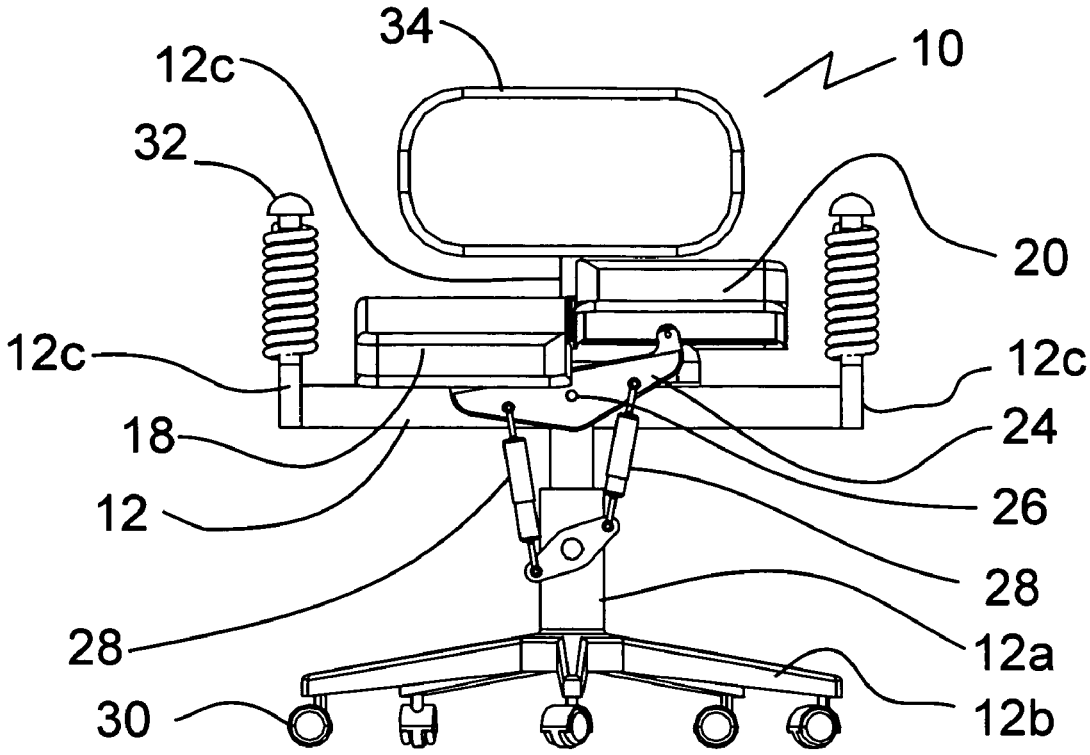
FIG. 2 is a front elevation view of the chair shown in FIG. 1 with the thigh activated levers repositioned.
Figure 3:
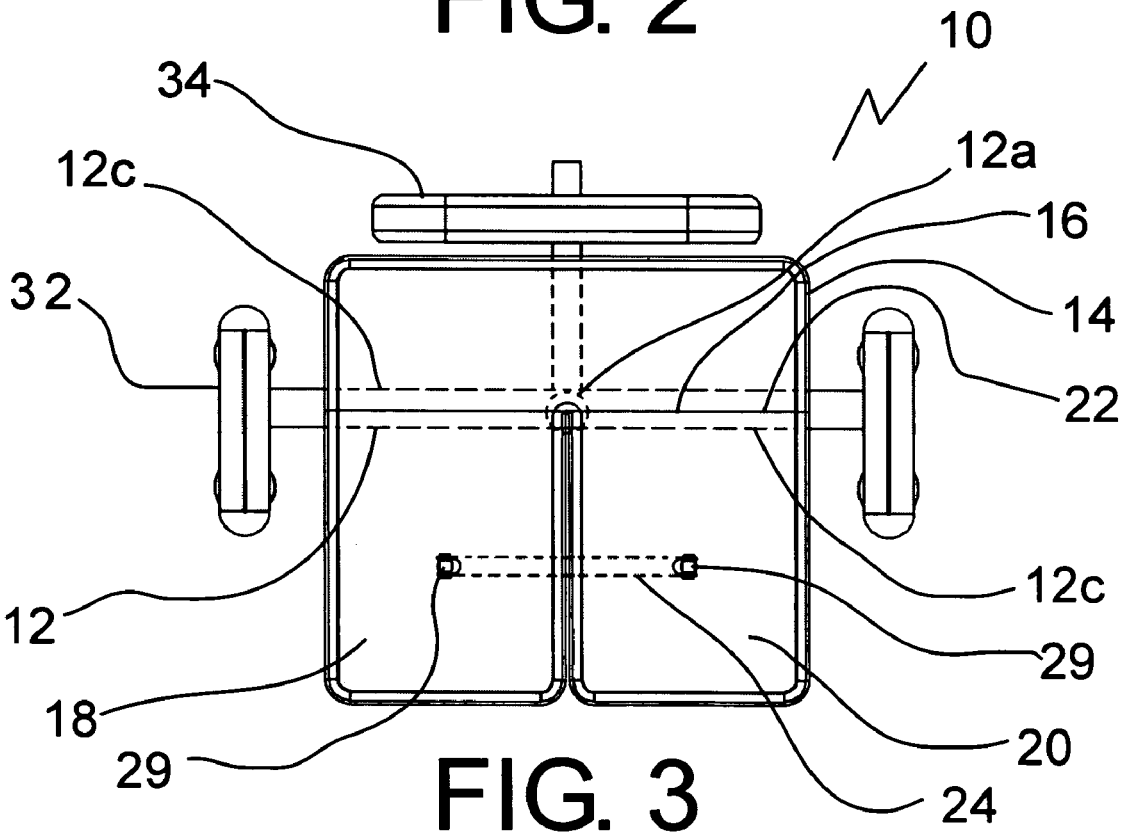
FIG. 3 is a partially transparent top plan view of the chair shown in FIG. 1.
Figure 4:
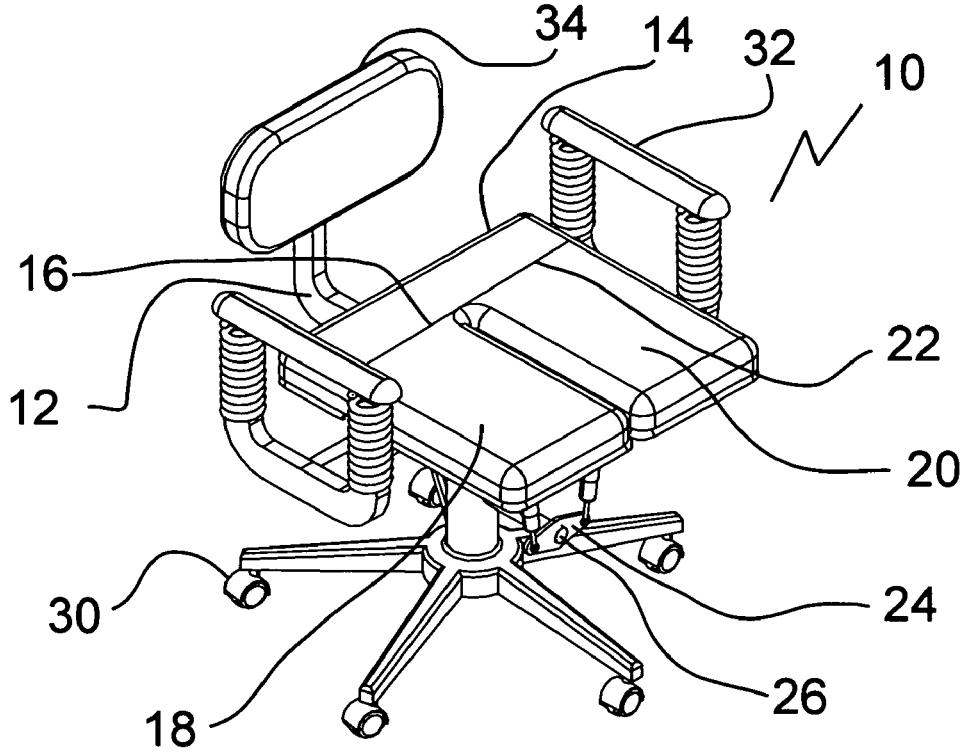
FIG. 4 is a perspective view of the chair shown in FIG. 1.

Structure:

Referring now to FIG. 1, there is shown chair 10 including a support structure 12. Support structure 12, as illustrated, consists a vertically extending member 12*a*, a base 12*b*, and members 12*c* extending outwardly from vertical member 12*a* to support arm rests and a back rest. Referring to FIG. 3 a seat 14 is fixed horizontally on support 12. Seat 14 has a front edge 16. A first thigh activated lever 18 and a second thigh activated lever 20 are pivotally mounted in side by side relation to front edge 16 of seat 14 for pivotal movement about a substantially horizontal pivot axis 22 that extends substantially parallel to front edge 16. It will be appreciated, that although first thigh activated lever 18 and second thigh activated lever 20 are illustrated as being attached to seat 14, they could be pivotally mounted directly to a structure on support 12. Referring to FIG. 1, a lever support rocker 24 is pivotally mounted to support 12. Referring to FIG. 2, lever support rocker 24 pivotally moves about a substantially horizontal pivot axis 26 that extends substantially perpendicularly to front edge 16 of seat 14. Referring to FIG. 1, pivot axis 26 is created by a pivot pin 27. Referring to FIG. 2, shock absorbers 28 serve as means for biasing lever rocker support 24 in a neutral position. These shock absorbers can be in the form of springs shock absorbers, hydraulic shock absorbers, gas shock absorbers, or anything that would serve a similar function. Rollers 29 are mounted to lever support rocker 24. Rollers 29 create a rolling contact between lever support rocker 24 and each of first thigh activated lever 18 and second thigh activated lever 20. Base 12*b* of support 12 has underlying wheels 30 to enable it to roll along the floor. It is preferred that arm rests 32 and a back rest 34, also branch off of support 12, and for that purpose members 12*c* have been provided. It is preferred that arm rests 32 be supported on springs, that will enable the user to do upper body exercises, as will hereinafter be further described.

Operation:

Referring to FIG. 2, while the user is seated on chair 10, downward pressure exerted by a user's thigh to lower first thigh activated lever 18 causes a rocking movement of lever support rocker 24 which results in an upwardly movement of second thigh activated lever 20. Similarly, downward pressure exerted by a user's thigh to lower second thigh activated lever 20 causes a rocking movement of lever support rocker 24 which results in an upwardly movement of first thigh activated lever 18. Contact between lever support rocker 24 and first thigh activated lever 18 and second thigh activated lever 20 is a rolling contact through rollers 29, which allows movement without friction or binding. The above described rocking movements must be deliberately initiated by the user, as shock absorbers 28 dampen all movements and act to bias lever support rocker 24 into a neutral position. Shock absorbers 28 resist pivotal movement of lever support rocker 24 until a sufficient amount of downward pressure is exerted by the user's thigh. The amount of pressure may be predetermined or adjustable to provide for maximum benefit. Arm rests 32 are supported on springs. This enables the user to exercise the upper body by pushing arm rests 32 outwardly away from seat 14 or pulling arm rests inwardly toward seat 14. It is appreciated that the above described thigh and arm movement are limited. It will be appreciated, however, that the primary purpose of chair 10 is not an exercise apparatus, it is intended to incorporate in the structure of a chair means for movement by the user to prevent injuries that occur due to lack of movement.

Figure 5:
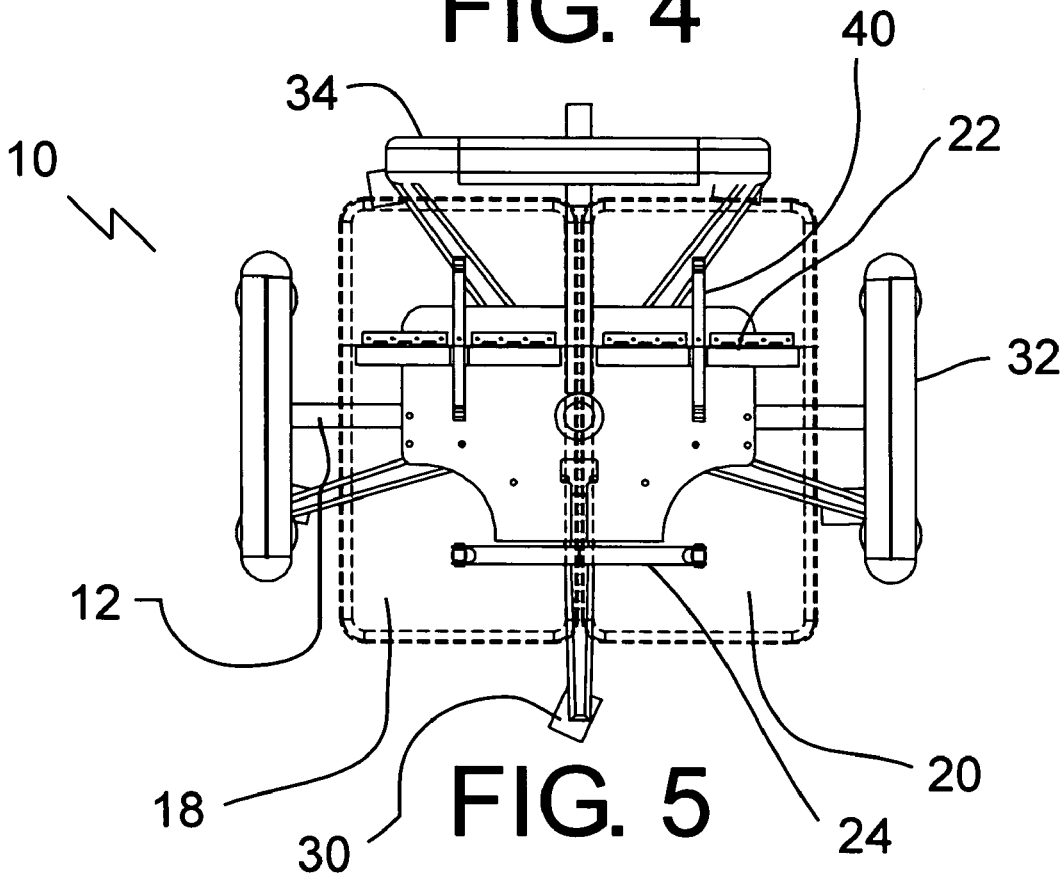
FIG. 5 is a partially transparent top plan view of a variation of the chair shown in FIG. 1.
Figure 6:
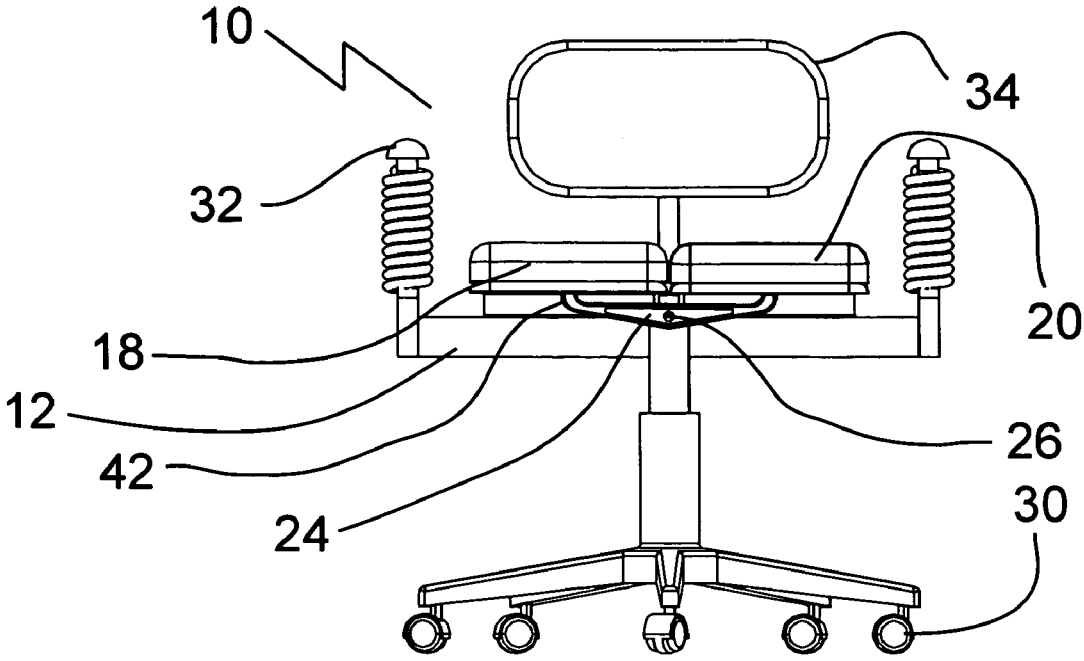
FIG. 6 is a front elevation view of a further variation of the chair shown in FIG. 1.
Figure 7:
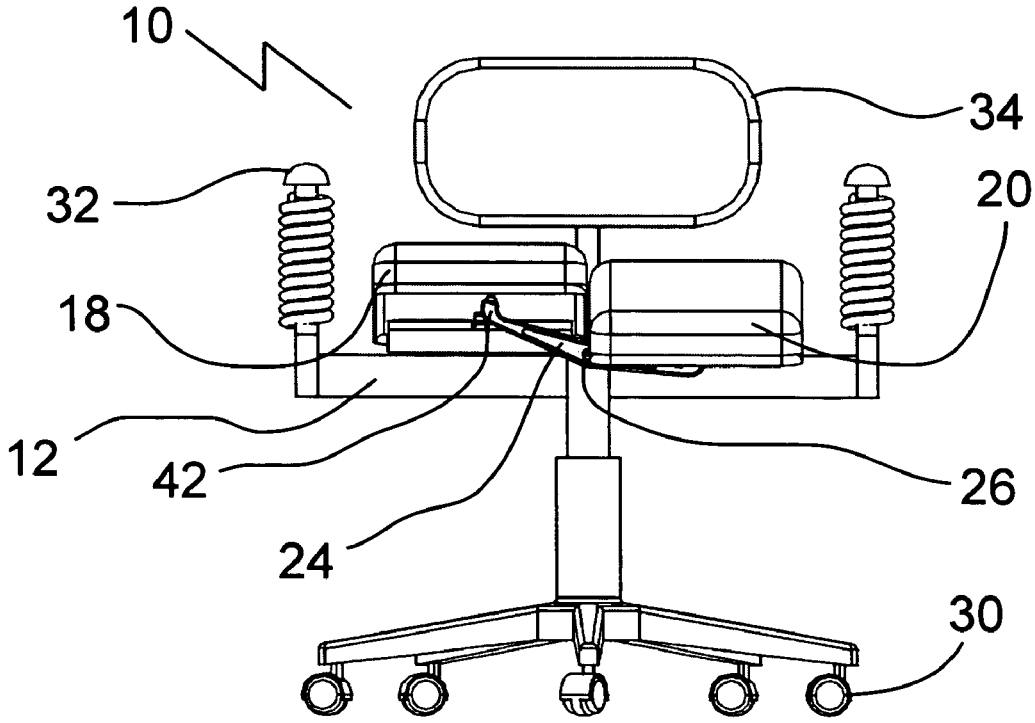
FIG. 7 is a front elevation view of the chair shown in FIG. 6 with the thigh activated levers repositioned.
Figure 8:
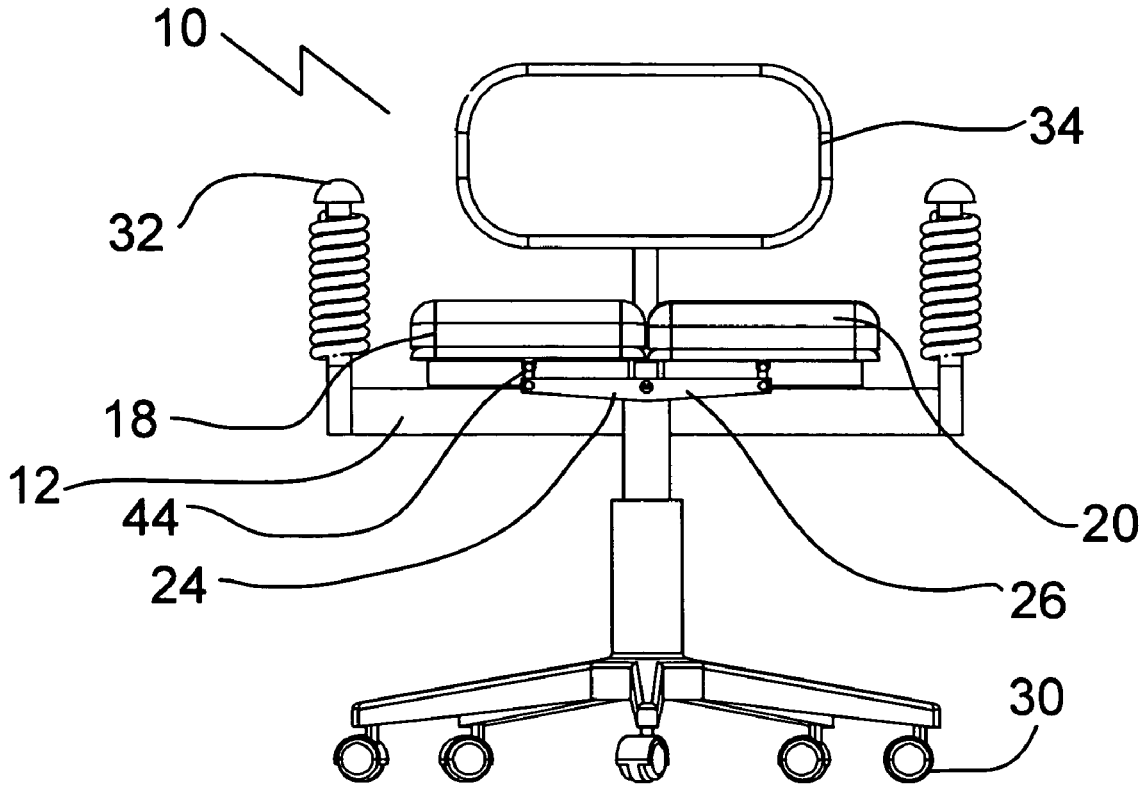
FIG. 8 is a front elevation view of a further variation of the chair shown in FIG. 1.
Figure 9:
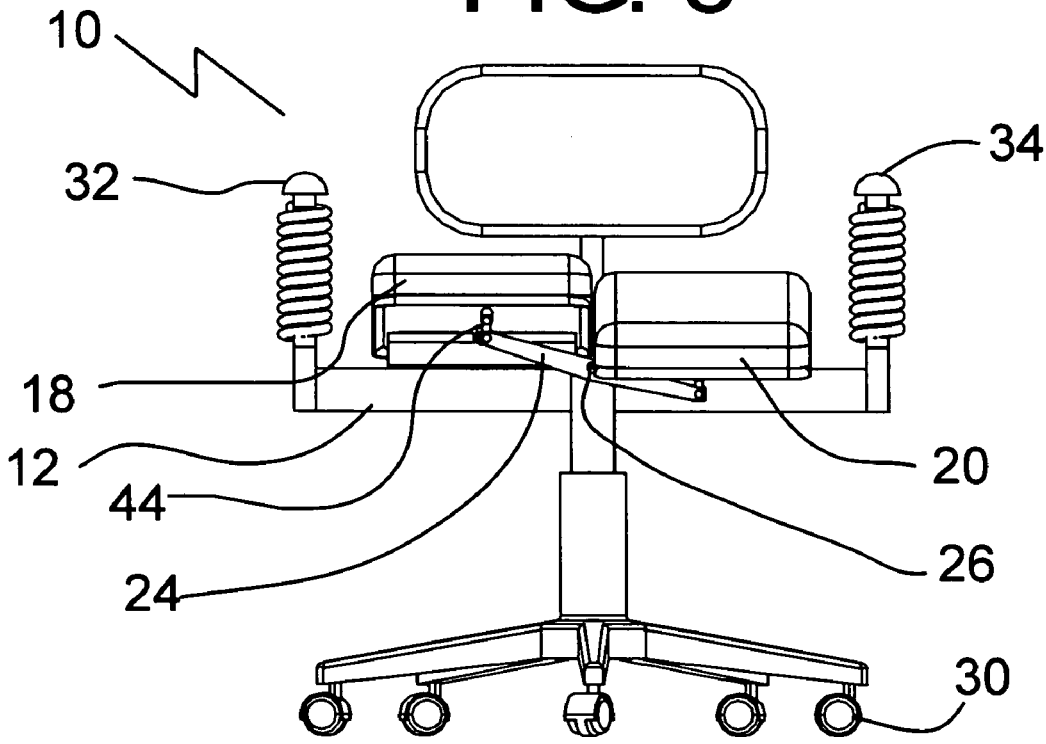
FIG. 9 is a front elevation view of the chair shown in FIG. 6 with the thigh activated levers repositioned.

Variations:

Variations of the above embodiment will now be described with reference to FIG. 5 through 10. It will be understood that there are different ways of implementing the teachings of the present invention. For example, while FIG. 1 shows shock absorbers or pistons 28 as a way to bias lever rocker support 24 in a neutral position, other means may be used. An example of such is shown in FIG. 5, where leaf springs 40 are attached to apply a force to each thigh activated lever 18 and 20 about horizontal pivot axis 22. As depicted, leaf springs 40 are used with an embodiment described below with respect to FIGS. 10 and 11. Another variation includes replacing rollers 29 with sliders 42 as shown in FIG. 6, or a rigid linkage 44 as shown in FIG. 8 in order to maintain a connection between lever support rocker 24 and each thigh activated lever 18 and 20 that was able to move based on the position of lever support rocker 24 and thigh activated levers 18 and 20. FIG. 7 and FIG. 9 show how slider 42 and linkage 44, respectively, are able to move as first thigh activated lever 18 is raised, and second thigh activated lever 20 is lowered.

Figure 10:
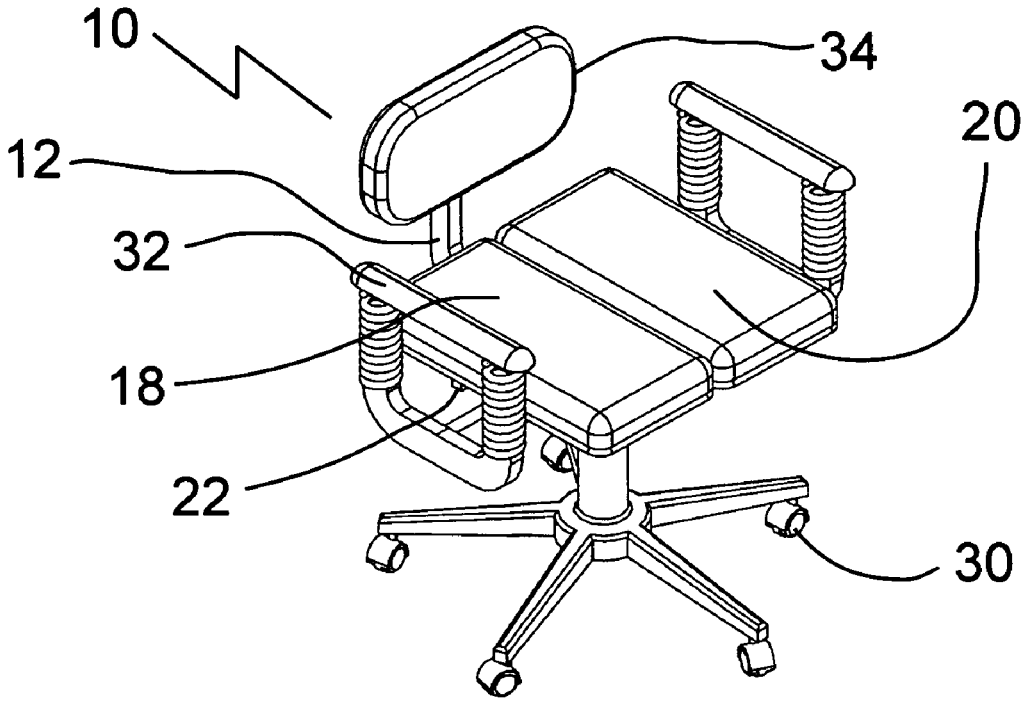
FIG. 10 is a perspective view of a further variation of the chair shown in FIG. 1.
Figure 11:
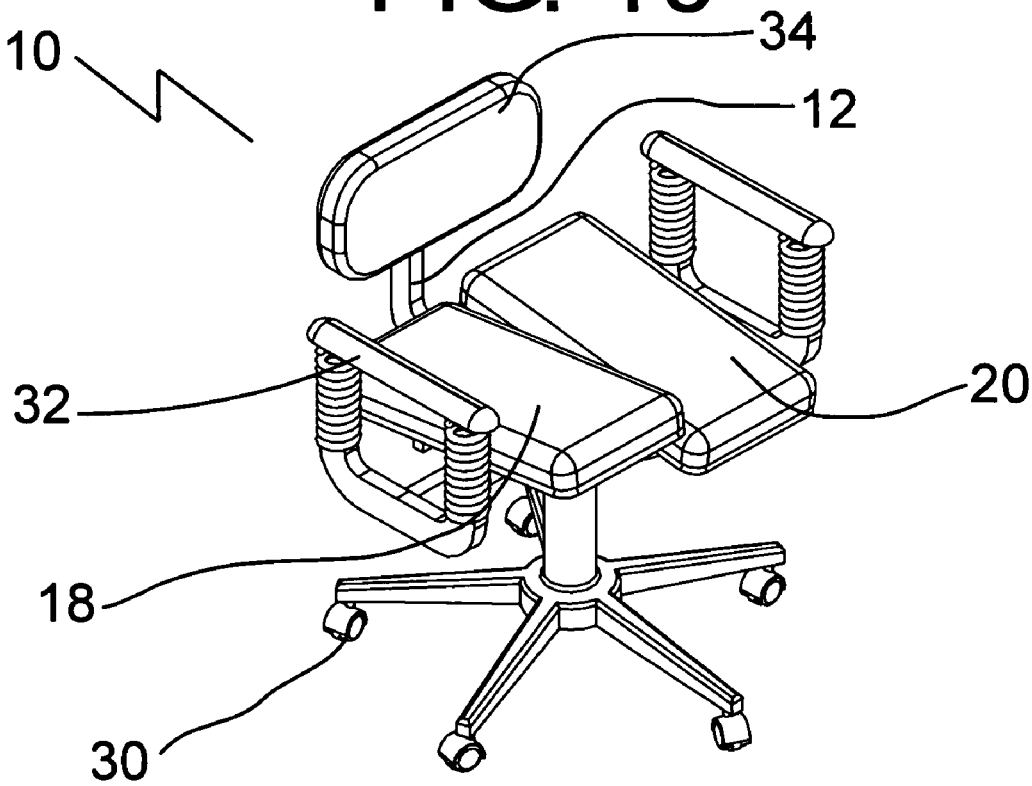
FIG. 11 is a perspective view of the chair shown in FIG. 10 with the thigh activated levers repositioned.

It will be understood that the teachings presented herein may be applied to many designs of chairs, and while chair 10 depicted with wheels 30, arm rests 32, and a back rest 34, this need not be the case with all designs. In addition, the design of seat 14 may also be altered. Referring to FIG. 10, instead of providing a stationary seat 14 with a first thigh activated lever 18 and a second thigh activated lever 20 as shown in FIG. 1, seat 14 may be removed, and thigh activated levers 18 and 20 may be extended, such that the user rests entirely upon thigh activated levers 18 and 20. Referring to FIG. 11, thigh activated levers 18 and 20 still pivot about horizontal pivot axis 22, however in this variation, as the front of each lever 18 and 20 moves up or down, the back moves down or up.

In this patent document, the word "comprising" is used in its non-limiting sense to mean that items following the words are included, but items not specifically mentioned are not excluded. A reference to an element by the infinite article "a" does not exclude the possibility that more than one of the elements is present, unless the context clearly requires that there be one and only one of the elements.

It will be apparent to one skilled in the art that modifications may be made to the illustrated embodiment without departing from the spirit and scope of the invention as hereinafter defined by claims.

What is claimed is:

1. A chair, comprising:

a support;

a seat supported by the support, the seat including a first thigh activated lever and a second thigh activated lever, the first thigh activated lever and the second thigh activated lever being positioned in side by side relation and pivotally mounted for pivotal movement about a substantially horizontal transverse shared pivot axis;

a lever support rocker underlying the first thigh activated lever and the second thigh activated lever and pivotally mounted to the support for pivotal movement about a substantially horizontal second pivot axis extending substantially perpendicularly to the shared pivot axis, such that downward pressure exerted by a user's thigh to lower one of the first thigh activated lever or the second thigh activated lever causes a rocking movement of the lever support rocker about the second pivot axis which results in an upwardly movement of the other of the first thigh activated lever or the second thigh activated lever.

2. A chair, comprising:

a support:

a seat supported by the support, the seat including a first thigh activated lever and a second thigh activated lever, the first thigh activated lever and the second thigh activated lever being positioned in side by side relation and pivotally mounted for pivotal movement about a substantially horizontal transverse shared pivot axis:

a lever support rocker underlying the first thigh activated lever and the second thigh activated lever and pivotally mounted to the support for pivotal movement about a substantially horizontal second pivot axis extending substantially perpendicularly to the shared pivot axis such that downward pressure exerted by a user's thigh to lower one of the first thigh activated lever or the second thigh activated lever causes a rocking movement of the lever support rocker about the second pivot axis which results in an upwardly movement of the other of the first thigh activated lever or the second thigh activated lever; and means for biasing the lever support rocker into a neutral position and resisting pivotal movement of the lever support rocker until a predetermined amount of downward pressure is exerted by the user's thigh.

3. The chair as defined in claim 2, wherein the seat has a stationary portion with a front edge, the first thigh activated lever and the second thigh activated lever both being pivotally mounted in side by side relation to the front edge of the stationary portion of the seat.

4. The chair as defined in claim 2, wherein the means for biasing the lever support rocker into a neutral position are telescopically extendible and retractable shock absorbers.

5. The chair as defined in claim 4, wherein the shock absorber is one of a spring shock absorber, a hydraulic shock absorber or a gas shock absorber.

6. The chair as defined in claim 2, wherein the means for biasing the lever support rocker into a neutral position are springs.

7. The chair as defined in claim 2, wherein rollers are mounted to the lever support rocker, thereby creating rolling contact between the lever support rocker and each of the first thigh activated lever and the second thigh activated lever.

8. The chair as defined in claim 2, wherein sliders are mounted to the lever support rocker, thereby creating sliding contact between the lever support rocker and each of the first thigh activated lever and the second thigh activated lever.

9. The chair as defined in claim 2, wherein pivoting linkages connects the lever support rocker and each of the first thigh activated lever and the second thigh activated lever.

10. The chair as defined in claim 2, wherein spring mounted arm rests are supported by the support.

11. A chair, comprising:

a support including a vertical member extending upwardly from a base;

a seat fixed to the vertical member of the support, the seat having a front edge;

a first thigh activated lever and a second thigh activated lever both pivotally mounted in side by side relation to one of the support or the seat for pivotal movement about a substantially horizontal pivot axis extending substantially parallel to the front edge of the seat;

a lever support rocker pivotally mounted to the support for pivotal movement about a substantially horizontal pivot axis extending substantially perpendicularly to the front edge of the seat, such that downward pressure exerted by a user's thigh to lower one of the first thigh activated lever or the second thigh activated lever causes a rocking movement of the lever support rocker which results in an upwardly movement of the other of the first thigh activated lever or the second thigh activated lever;

rollers mounted to the lever support rocker and adapted to create rolling contact between the lever support rocker and each of the first thigh activated lever and the second thigh activated lever; and at least one shock absorber biasing the lever support rocker into a neutral position and resisting pivotal movement of the lever support rocker until a predetermined amount of downward pressure is exerted by the user's thigh.

12. The chair as defined in claim 11, wherein the at least one shock absorber is one of a spring shock absorber, a hydraulic shock absorber or a gas shock absorber.

13. The chair as defined in claim 11, wherein spring mounted arm rests are supported by members extending outwardly from the vertical member.

14. A chair, comprising:

a support;

a seat supported by the support, the seat including a first thigh activated lever and a second thigh activated lever, the first thigh activated lever and the second thigh activated lever being positioned in side by side relation and pivotally mounted for pivotal movement about a substantially horizontal transverse shared pivot axis;

a lever support rocker underlying the first thigh activated lever and the second thigh activated lever and pivotally mounted to the support for pivotal movement about a substantially horizontal second pivot axis extending substantially perpendicularly to the shared pivot axis, such that downward pressure exerted by a user's thigh to lower one of the first thigh activated lever or the second thigh activated lever causes a rocking movement of the lever support rocker about the second pivot axis which results in an upwardly movement of the other of the first thigh activated lever or the second thigh activated lever; and springs bias the lever support rocker into a neutral position and resist pivotal movement of the lever support rocker until a predetermined amount of downward pressure is exerted by the user's thigh.

* * * * *